US006439388B1

(12) United States Patent
Lerner

(10) Patent No.: US 6,439,388 B1
(45) Date of Patent: Aug. 27, 2002

(54) SELF-BALANCING, SINGLE-HAND FOOD HOLDER

(76) Inventor: Louis L. Lerner, The Lerner Group, P.O. Box 10601, Chicago, IL (US) 60610-0601

( * ) Notice: Subject to any disclaimer, the term of this patent is extended or adjusted under 35 U.S.C. 154(b) by 36 days.

(21) Appl. No.: 09/620,081

(22) Filed: Jul. 20, 2000

(51) Int. Cl.[7] ..... B65D 6/04
(52) U.S. Cl. ..... 206/562; 224/219
(58) Field of Search ..... 206/557, 562–564, 206/477–479, 503, 509; 108/43; 220/23.8, 575, 556, 735, 737; 224/164, 165, 219, 152; 294/143, 144

(56) References Cited

U.S. PATENT DOCUMENTS

| | | | | | |
|---|---|---|---|---|---|
| 1,609,481 | A | * | 12/1926 | McCarthy et al. | 224/219 |
| 2,679,971 | A | | 6/1954 | Goldberg | |
| 2,762,377 | A | * | 9/1956 | Stephens | 224/219 |
| 3,009,623 | A | | 11/1961 | Wenzel | |
| 3,162,344 | A | * | 12/1964 | Sabol | 294/143 |
| 3,532,247 | A | * | 10/1970 | Bridges | 206/503 |
| 3,637,130 | A | | 1/1972 | Farquhar | |
| 3,656,681 | A | | 4/1972 | Goings | |
| 3,915,371 | A | | 10/1975 | Crabtree | |
| 4,156,484 | A | | 5/1979 | Wischusen | |
| 4,401,233 | A | * | 8/1983 | Frey | 224/219 |
| 5,058,737 | A | | 10/1991 | Patterson et al. | |
| 5,119,967 | A | * | 6/1992 | Ercolani | 206/564 |
| 5,205,449 | A | * | 4/1993 | Davies | 224/219 |
| 5,249,700 | A | | 10/1993 | Dumke | |
| 5,292,028 | A | | 3/1994 | Patterson et al. | |
| 5,346,070 | A | | 9/1994 | McSpadden | |
| 5,695,052 | A | | 12/1997 | Damato | |
| 5,747,084 | A | | 5/1998 | Cochran et al. | |
| 5,957,276 | A | | 9/1999 | Cutler et al. | |
| 6,227,424 | B1 | * | 5/2001 | Roegner | 224/219 |

* cited by examiner

*Primary Examiner*—Luan K. Bui
(74) *Attorney, Agent, or Firm*—Olson & Hierl, Ltd.; Dolores T. Kenney

(57) ABSTRACT

Disclosed is a self-balancing food holder for single hand use comprising a platter for receiving and supporting food and a lower surface for engaging the hand of a user and a restraint member connected to the edge of the platter at laterally spaced locations. The restraint member has a restraining portion vertically spaced from the lower surface of the platter such that the user's hand can be interposed between the platter and the restraining portion. A preferred food holder has features for holding one or more dining accessories. The platter and restraint member can be formed from an initially flat sheet of material.

34 Claims, 3 Drawing Sheets

SELF-BALANCING, SINGLE-HAND FOOD HOLDER

TECHNICAL FIELD OF THE INVENTION

This invention relates generally to food plates and more particularly to self-balancing food holders for single-hand use during stand up eating or self-serve style food service.

BACKGROUND OF THE INVENTION

At many social gatherings where food is served, such as wedding receptions, cocktail parties, barbecues and the like, guests are often required to stand while holding food laden plates, drinks and dining accessories, such as napkins, eating utensils and the like. Often, the guests must hold both their plate and drink container while passing through a self-service buffet line or while being served and then balance the plate and all dining accessories while returning to their seats. The guests may have to stand while eating because of a lack of seating or table space. In addition, some guests may desire to mingle and choose to stand.

In order to simultaneously hold and balance a plate and a drink container while standing, a person must use both hands, one to hold the plate and one to hold the drink. This is very inconvenient and awkward when the person needs at least one hand free, such as for eating or serving himself from a buffet table, and may require the person to find a nearby surface, such as a table, upon which to place the drink container. In addition to the inconvenience of having to put the drink container down, the person's drink may be knocked over, be confused with the drink containers of other guests if many guests are present at the function, or be inadvertently disposed of by the wait staff who assume the drink has been abandoned. Additionally, it is difficult to also simultaneously hold a napkin and eating utensils while standing.

Some plates or food trays in the prior art have attempted to resolve some of the problem by providing a portion for receiving food and another portion for supporting a drink container. In trying to hold such a conventional food tray with one hand, most users would support the tray by grasping the rim of the tray. When a full drink container is placed on one of these trays, however, the tray becomes unbalanced because of the added weight and is difficult to hold with one hand. Most users would need to compensate by grasping the rim of the tray with both hands especially when the plate is also fully laden with food.

In order to free one hand for eating or self service, users desirably can more securely hold the plate in one hand with the palm supporting the underside of the plate. This is a precarious way to hold and carry the plate, however, since it is relatively easy for the plate to slide off an inadvertently tipped palm. Another hazard is that an edge of the plate might be struck inadvertently, causing the plate to flip or slide off the user's hand.

One prior attempt to address the problem provided a portable food tray with cup holder and is described in U.S. Pat. No. 5,346,070 to McSpadden. However, the user is required to support the tray on a portion of the hand and wrist and firmly grasp the cup holder portion with the fingers. The tray has no provisions for holding dining accessories prior to use and does not resolve the hazard of having the edge of the tray flip off the hand.

There is a need for a self-balancing food plate that can be carried in one hand and yet have its rim be relatively secure against falling or sliding off, the user's hand. It would also be desirable to provide such a self-balancing food plate having a provision for simultaneously carrying a drink or other liquid container. It would be further desirable to provide such a self-balancing food plate having provisions for holding one or more dining accessories, before, during and after usage.

These and other desirable features are provided by the present invention.

SUMMARY OF THE INVENTION

Disclosed is a self-balancing food holder onto which food can be served or from which food can be eaten while being carried by one hand of a user. The self-balancing, single-hand food holder comprises a platter having an upper surface for receiving and supporting food, and a lower surface for engaging the hand of the user and a restraint member connected to the edge of the platter at laterally spaced locations. The restraint member has a restraining portion vertically spaced from the lower surface of the platter to define a passage for receiving the user's hand in interposed relationship between the platter and the restraining portion. When the hand is so received, the platter can be carried or held securely, preferably by the palm of the user's hand, and is restrained against tipping or falling from the user's hand. Thus, the food holder advantageously is self-balancing against slipping sideways off the user's hand.

The present invention provides a self-balancing, single-hand food holder that can be carried or held in one hand and is especially useful for stand up eating, self-serve buffet style food service and the like. The novel self-balancing, single-hand food holder of the present invention further advantageously provides for holding dining accessories before, during, and after usage. Additionally, the inventive food holder can also be employed for table usage, if the user so desires. Beneficially, the restraint portion of the inventive self-balancing, single-hand food holder can be self-adjusting to accommodate various hand sizes and can be dimensionally sized for use by children as well as adults.

Other advantages of the present invention will be apparent from the following description of preferred embodiments made with reference to the drawings.

DESCRIPTION OF THE PREFERRED EMBODIMENTS

Figure 1:
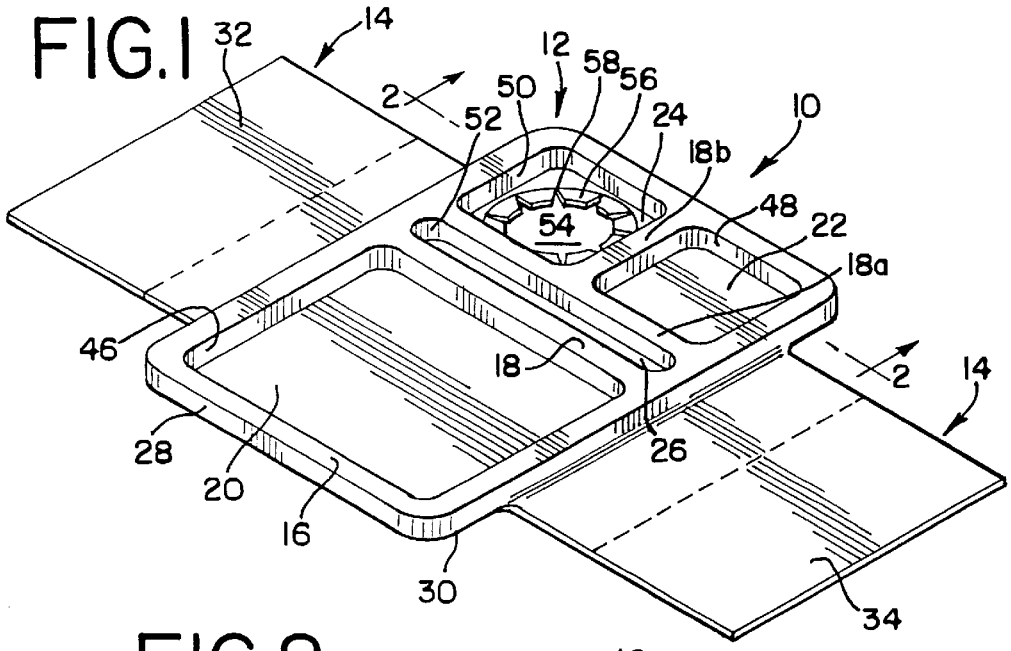
FIG. 1 is a perspective view of a first embodiment of a single-hand food holder in accordance with the present invention, shown in a first configuration.
Figure 2:
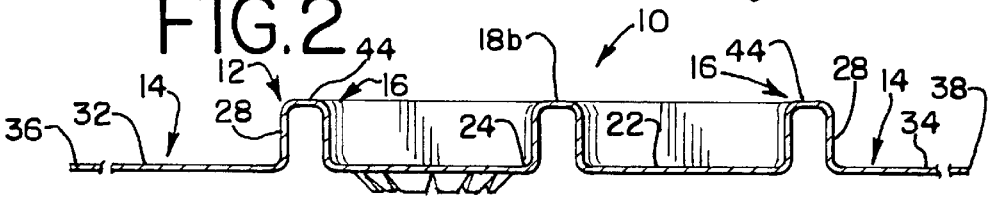
FIG. 2 is a cross-sectional view of the food holder of FIG. 1 taken in vertical plane 2—2 of FIG. 1 and viewed in the direction of the arrows.
Figure 3:
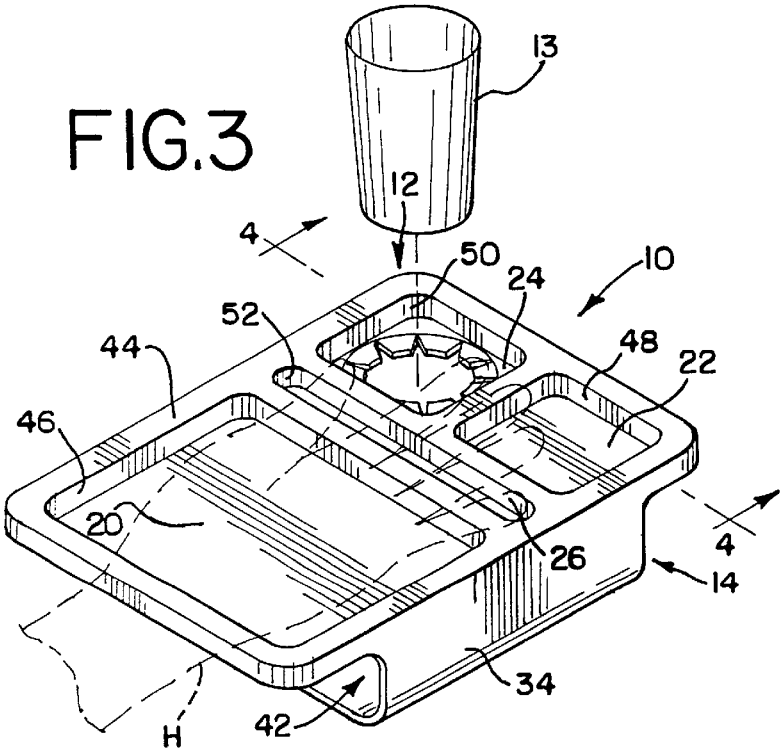
FIG. 3 is a perspective view of the single-hand food holder of FIG. 1, shown in a second configuration.

Referring to FIGS. 1–3, shown is a first configuration of a first preferred embodiment of a self-balancing, single-hand food holder 10 in accordance with the present invention. Food holder 10 includes a platter 12 for receiving and supporting thereon solid food and a liquid holding container 13, such as for soup or a drink, and a restraint member 14 for securing platter 12 to the hand H of a user.

As shown in FIG. 1, platter 12 and restraint member 14 are preferably unitary and integrally formed from an initially flat sheet of liquid-impermeable, self-supporting material, preferably paper, such as paper board or compressed paper, or plastic. Platter 12 can be formed into a three dimensional body by pressing at least one portion of the initially flat sheet between complementary male and female dies. The dies are configured to form an upstanding perimetrical rim 16 to impart rigidity and enhanced self-supporting strength to platter 12. The upstanding perimetrical rim 16 also provides a barrier for restraining food on platter 12 against excessive lateral displacement that could result in food falling from platter 12.

As preferred and best seen in FIGS. 1, 2 and 3, other intermediate upstanding ridges 18, 18*a* and 18*b* are formed in platter 12 to define adjacent compartments 20, 22, 24 and 26 for receiving, for example, an entree, a side serving, a liquid holding container 13, and eating utensils, respectively. Compartment 26 is preferably recessed sufficiently deep enough and elongated enough to hold at least one eating utensil, more preferably at least a fork, knife and spoon, therein. Platter 12 further includes, proximate to perimetrical rim 16, an outer perimetrical wall 28 defining a free perimetrical edge 30. The perimetrical edge 30 is preferably rectangular but can be rounded so long as the restraint member can be functionally attached. Integral with perimetrical wall 28 and extending from perimetrical edge 30 are a pair of wings 32 and 34 which form the restraining portions of restraint member 14 as described below.

Figure 4:
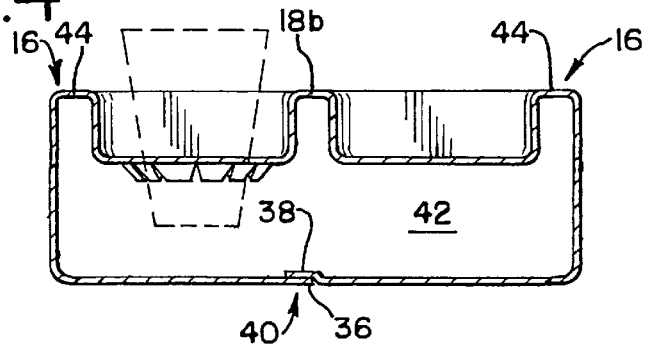
FIG. 4 is a cross-sectional view of the food holder of FIG. 1 in the second configuration of FIG. 3, taken in vertical plane 4—4 of FIG. 3 and viewed in the direction of the arrows.

Referring to FIGS. 3 and 4, wings 32 and 34, which initially extended in opposite directions from opposite sides of the free perimetrical edge 30 of perimetrical wall 28 in substantially the same plane as that of platter 12, have been folded downwardly and inwardly so that free ends 36 and 38 meet each other below platter 12 and are bonded together. Bonding preferably is by way of a lap joint 40 secured with a self-adhesive but is not limited thereto. Other means for joining the free ends 36 and 38 can be tabs and slots, staples, tape, and the like. When so joined, wings 32 and 34 form a restraint member 14 in the form of a wide strap that extends from one side of platter 12 to an opposite side of platter 12, while being spaced sufficiently from the lower surface of platter 12 to define a passage 42 between restraint member 14 and platter 12 sized to receive at least the palm portion of a human user's hand H between platter 12 and restraint member 14.

As shown in FIG. 3, the user's hand H is preferably inserted palm facing up and placed in engagement with the lower surface of platter 12. In this aspect, restraint member 14 crosses under the back of the hand H. Preferably, the passage 42 defined between restraint member 14 and platter 12 is sized large enough to comfortably receive the full range of sizes of normal human user's hands, and yet is sized small enough that restraint member 14 is disposed in sufficiently close proximity to the back of the user's hand H to perform a restraining function.

Restraint member 14 also functions to self-balance the food holder during single hand usage. Restraint member 14 alleviates or substantially prevents platter 12 from slipping laterally from the user's hand, from tipping off the user's hand, from generally falling from the user's hand due to an imbalanced condition caused by an uneven distribution of food on platter 12, or by an edge of platter 12 being accidentally struck against or striking another object as the user is moving about with the food laden platter 12 in hand. Enhanced security against dropping platter 12 or otherwise causing an embarrassing or messy spill is provided by the self-balancing benefit provided by the restraint member 14.

Again referring to FIGS. 1–4, the upstanding perimetrical rim 16, in addition to the aforementioned outer perimetrical wall 28, includes a top wall 44. Upstanding perimetrical rim 16 also includes an inner wall 46 shared with compartment 20, an inner wall 48 shared with compartment 22, an inner wall 50 shared with compartment 24, and an inner wall 52 shared with compartment 26. The upstanding perimetrical rim 16 and intermediate upstanding ridges 18, 18*a* and 18*b* cooperate to form intersecting beams that impart rigidity against deformation to platter 12.

With particular reference to FIGS. 1–5, compartment 24 defines an aperture 54 through the floor thereof for securely receiving a liquid holding container 13 therethrough. In the preferred embodiment illustrated, aperture 54 is defined by a generally circular opening in the floor of compartment 24 surrounded by a plurality of radially inwardly directed tooth members 56. Each one of the tooth members 56 is formed substantially as a truncated triangle, with triangular notches 58 between adjacent tooth members 56. The shape of tooth members 56 together with the shape of the intermediate notches 58 permit tooth members 56 initially to lie flat in the plane of the floor of compartment 24. Inserting a liquid holding container 13, such as a drink glass, cup or the like, through aperture 54 from above causes the tooth members 56 to be deflected downwardly, while remaining biased inwardly and upwardly in snug contact with the liquid holding container 13.

Preferably, the liquid holding container 13 can be tapered downwardly so that the diameter of the container will match that of the aperture 54 part way down the height of the container. This permits the center of gravity of the liquid holding container 13 to sit low relative to the general plane of platter 12 to preventing tipping of the contents of the liquid holding container.

Other configurations of the aperture 54 also can be square, triangular, or the like, defined by appropriate scoring or perforations, so long as the aperture can releasably receive and secure a liquid holding container. For these embodiments, the configuration of all or a portion of the liquid holding container can be similar to the aperture as well.

Figure 5:
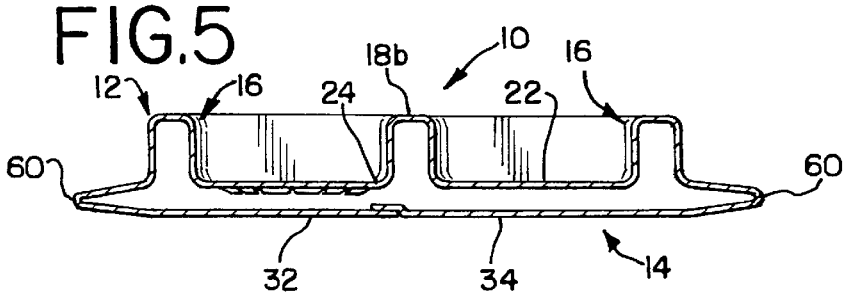
FIG. 5 is a cross-sectional view similar to that of FIG. 4, in which the food holder of FIG. 1 is shown in a third configuration.

Referring now to FIG. 5, a third preferred configuration of the self-balancing, single-hand food holder 10 is illustrated, in which the restraint member 14, assembled as in FIGS. 3 and 4, is in a collapsed condition. In this configuration, score lines or fold lines 60 are provided in wings 32 and 34 to permit the restraint member 14 to bow outwardly and collapse under the weight of a food laden platter 12 when the platter 12 is set upon a flat horizontal surface, such as a table.

Thus, restraint member 14 serves its function of restraining platter 12 on the hand of the user while being carried about, yet does not interfere with the normal use of platter 12 should the user elect to sit down at a table to eat.

Figure 6:
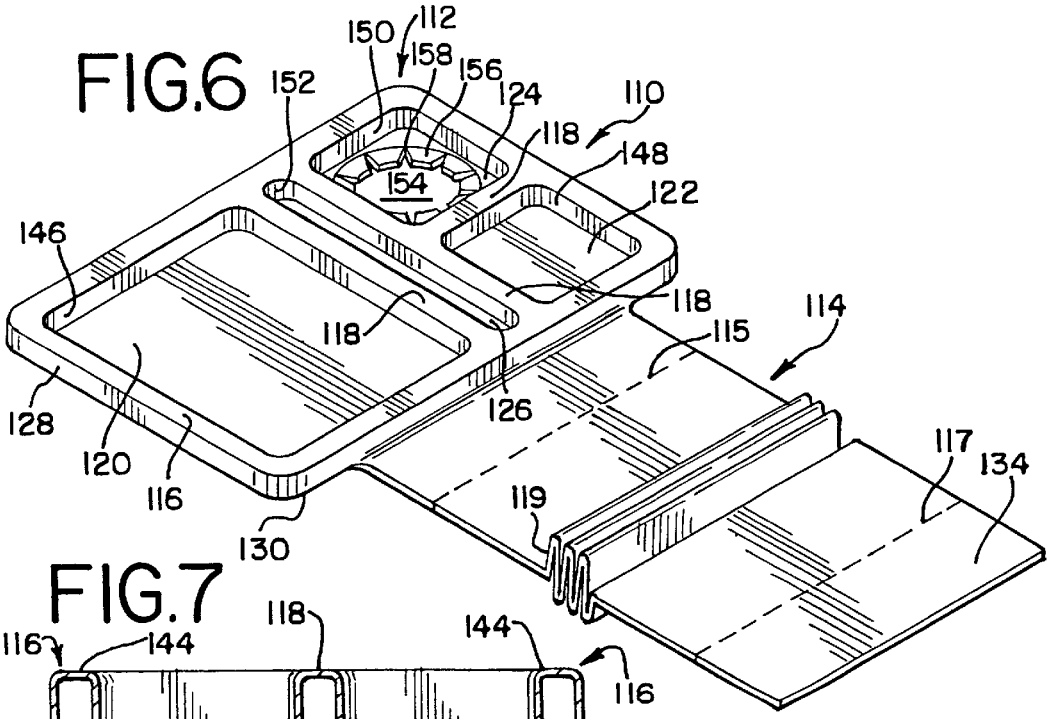
FIG. 6 is a perspective view of a second embodiment of a single-hand food holder in accordance with the present invention.
Figure 7:
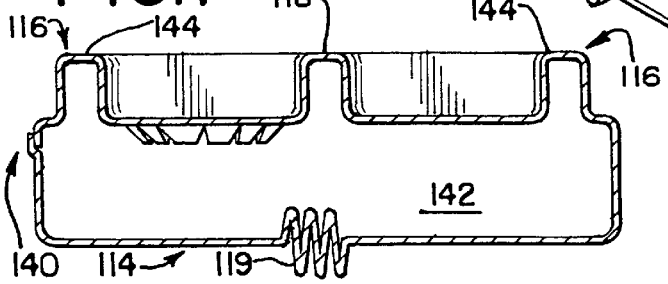
FIG. 7 is a cross-sectional view of the food holder of FIG. 6, shown in a second configuration.

Referring to FIGS. 6 and 7, a second preferred embodiment of a self-balancing, single-hand food holder 110 is illustrated in accordance with the present invention. The embodiment of FIG. 6 is similar in many respects to the embodiment depicted in FIGS. 1–5 and described above, and similar components are indicated by similar reference numerals in the 100 series. Food holder 110 includes a platter 112 having compartments 120, 122, 124 and 126 for holding, respectively, an entrée, a side serving, a liquid-holding container and eating utensils. Other elements of the platter 112 in common with the first embodiment, not specifically described below, are as described above with respect to food holder 10.

Unlike the restraint member of food holder 10, the restraint member 114 of food holder 110 includes a restraining portion having a single wing 134 integrally extending from one side only of the free perimetrical edge 130 of platter 112, as shown in FIG. 6. Rather than having two wings 32 and 34 that each fold under platter 12 and join at a seam in the middle therebelow, as in the first embodiment, the single wing 134 of the second embodiment is folded at fold lines 115 and 117 under platter 12 and its single free end is joined to the opposite side of platter 112 such as by a lap joint 140, as shown in FIG. 7, overlying outer perimetrical wall 128 and secured, for example, with a self-adhesive. As in the first embodiment, other means for securing the restraint member 114 to the platter 112 can be used, such as tabs and slots, tape, staples, and the like so long as the restraint is secured.

Optionally, the restraint member 114 shown in FIGS. 6 and 7 can be provided with an accordian fold member 119 intermediate the free end of wing 134 and free perimetrical edge 130. Accordian fold member 119 provides for expansion of restraint member 114 to accomodate a large hand received within passage 142. The length of wing 134 can be selected such that when wing 134 is folded under platter 112 and connected to the opposite side of platter 112, with the accordian fold member 119 in a compactly folded initial configuration, passage 142 is sized to fit small hands. If a larger hand is inserted within passage 142, the accordian fold member 119 is placed in tension and automatically expands to create a larger passage 142 to accomodate the larger hand. Consequently, a self-adjusting restraint member is provided to fit a wide range of hand sizes. The accordian fold member 119 also could be incorporated into the embodiments shown in FIGS. 1–5, if desired.

Figures 8, 9:
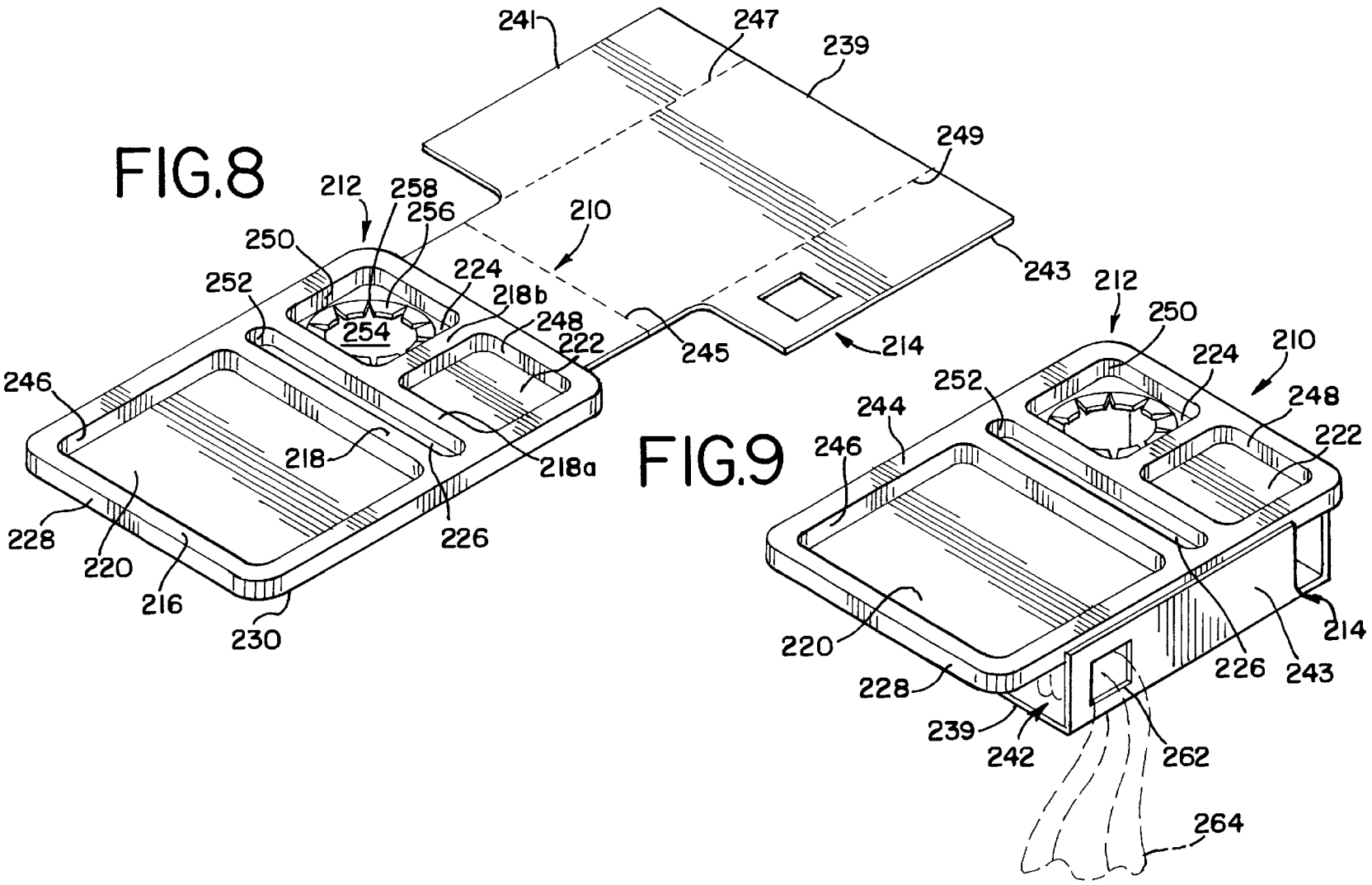
FIG. 8 is a perspective view of a third embodiment of a single-hand food holder in accordance with the present invention, shown in a first configuration.
FIG. 9 is a perspective view of the single-hand food holder of FIG. 7, shown in a second configuration.

With reference to FIGS. 8 and 9, a third preferred embodiment of a self-balancing, single-hand food holder 210 is illustrated in accordance with the present invention. Those elements and components of the present embodiment that are similar in form and function to elements and components of the first embodiment shown in FIGS. 1–5 and described above are designated by similar reference numerals in the 200 series. Elements in common with the platter portion of the first embodiment, not specifically described below, are as described above with respect to food holder 10.

The embodiment of FIGS. 8 and 9 differs from the first embodiment primarily with respect to the shape and placement of restraint member 214, which as shown extends from the end of platter 212 farthest from the user. In this embodiment, restraint member 214 includes a primary wing 239 extending from platter 212 and having a pair of side wings 241 and 243 extending in opposite directions on opposite sides of primary wing 239. Score, or fold, lines 245, 247 and 249 permit restraint member 214 to be folded neatly at discrete locations.

Starting with the configuration illustrated in FIG. 8, food holder 210 is folded into the configuration shown in FIG. 9. First, restraint member 214 is folded downwardly at the intersection of restraint member 214 and outer perimetrical wall 228. Restraint member 214 is again folded at fold line 245 such that primary wing 239 lies substantially beneath platter 212 yet spaced therefrom; Side wings 241 and 243 are each folded upwardly at score lines 247 and 249 respectively. The free ends of side wings 241 and 243 overlie outer perimetrical wall 228 of platter 212 and are secured thereto preferably by a self-adhesive. Other means for securing side wings 241 and 243 to platter 212 can be tabs and slots, tape, staples and the like.

When assembled for use as shown in FIG. 9, food holder 210 has a restraint member 214, comprised of side wing 241, primary wing 239 and side wing 243, in the form of a wide strap that is connected to platter 212 at laterally spaced locations on opposite sides thereof. Restraint member 214 is vertically spaced from platter 212 to define a passage 242 therebetween into which one hand of a user can be interposed. That portion of primary wing 239.between outer perimetrical wall 228 of platter 212 and score line 245 forms an end wall of restraint member 214 that at least partially occludes one end of the passage 242 defined between platter 212 and restraint member 214. That portion of wing 239 also provides support against collapse of restraint member 214 when platter 212, laden with food, is set upon a flat horizontal surface such as a table. This permits platter 212 to be set down temporarily and then be picked up again with one hand, since the hand of the user can be readily interposed in the passage 242 even when the food holder 210 is sitting on a surface laden with food.

A napkin holder can be optionally provided defined as an aperture 262 in one of the side wings 241 or 243 (shown as a rectangular aperture defined in side wing 243 in FIG. 9). A napkin 264 can be held therein when not in use and also easily withdrawn therefrom for use. Likewise, a napkin holder in the form of an aperture 262 can be provided in either one of restraint members 14 or 114 of the first or second embodiments, respectively, if desired. The napkin holder can be defined in other shapes, such as round, triangular, and the like and can be positioned on either the left side, or right side or both sides of the restraint member. The size of the napkin holder need only be sufficient to accommodate a corner of a napkin.

An added feature of the first, second or third single-hand food holder embodiments is that the napkin can be stowed within the passageway before usage and after usage for disposal or both.

The platter portion is preferably made of self-supporting material, such as molded plastic or paper having a moisture or liquid impermeable coating. The shape of a useful platter can be rectangular, oval, scalloped, oyster-shell or of any shape capable of not interfering with the function of the restraint member. The platter can be sized as desired for holding small snacks or meals, depending on the social function for which the food holder is intended. The compartments for the eating utensils 26, 126 and 226 of the embodiments are preferably sized in depth, length and width to hold at least one spoon, knife and fork and preferably all three.

The food holder is preferably dimensioned for use by either left-handed or right-handed persons. The food holder preferably is manufactured and stored with the wings of the restraint member unjoined to be assembled just before use. This beneficially allows the food holder to be stacked for storage and shipping or be packaged as a unit with the dining accessories, liquid-holding container, instructions and the like.

The food holder is preferably made of disposable materials for one time usage but can be made of reusable material if so desired. Preferably, the liquid holding container is made of similar material to that of the platter to desirably match the food holder.

It is particularly desirable to provide the food holder, napkin, liquid holding container and eating utensils as a matched decorative set. Preferably, such sets are packaged as units.

Although the invention has been described with reference to certain preferred embodiments, numerous modifications and variations can be made by those skilled in the art and yet remain within the scope of the invention. The detailed description of preferred embodiments is made by way of illustration and not limitation. The scope of the invention is defined by the claims appended below.

I claim:

1. A food holder onto which food can be served or from which food can be eaten, and which is self-balancing while being carried by one hand of a user, comprising:

a platter having an upper surface for receiving and supporting food, and a lower surface for engaging the hand of the user; and a restraint member connected to the platter at laterally spaced locations, the restraint member having a restraining portion capable of being vertically spaced from the lower surface of the platter to define a passage for receiving the user's hand in interposed relationship between the platter and the restraining portion such that the platter can be engaged securely by the hand of the user and restrained against sideways tipping or falling from the user's hand;

the platter and restraint member being intergrally formed, the restraining portion defining a wing extending from the platter, the restraining portion being subsequently foldable and the wing being joinable at a seam.

2. The food holder of claim 1 wherein the restraint member includes a first end and a second end, each end connected to the platter, the restraining portion being intermediate the first end and the second end.

3. The food holder of claim 1 wherein the platter includes a perimetrical edge, the restraint member being connected to the platter proximate the perimetrical edge.

4. The food holder of claim 3 wherein the perimetrical edge is substantially rectangular.

5. The food holder of claim 4 wherein the rectangular perimetrical edge defines a pair of opposite sides, the restraint member being attached to the platter proximate the opposite sides.

6. The food holder of claim 1 wherein the restraint member is collapsible to permit the platter to be placed on and supported by a flat horizontal surface with the lower surface of the platter in close proximity to the flat horizontal surface.

7. The food holder of claim 1 wherein the upper surface of the platter defines at least one compartment for receiving food therein and the compartment has a side wall for restraining the food against lateral displacement.

8. The food holder of claim 7 wherein the upper surface of the platter further defines at least one compartment for receiving at least one eating utensil therein.

9. The food holder of claim 1 further including a compartment having an aperture defined therein for receiving at least one liquid holding container therethrough.

10. The food holder of claim 1 wherein the upper surface defines at least one compartment for receiving food therein, at least one compartment having an aperture defined therein for receiving a liquid container therethrough, and at least one compartment having an elongate recess for receiving at least one eating utensil therein.

11. The food holder of claim 1 wherein at least the upper surface of the platter comprises liquid impermeable material.

12. The food holder of claim 1 wherein the restraint member includes at least one napkin holder defined as an aperture therein.

13. The food holder of claim 1 wherein the platter is composed of paper or plastic.

14. The food holder of claim 1, further including a restraint end wall connected to the platter and at least partially occluding one end of the passage to define a pocket for receiving the user's hand, a napkin, or both therein.

15. The food holder of claim 14 wherein the restraint end wall is connected to the restraint member.

16. The food holder of claim 15 wherein the restraint member and restraint end wall have sufficient structural strength to support the platter above a substantially flat horizontal surface without collapsing in use.

17. The food holder of claim 1 wherein the platter is sufficiently rigid to avoid substantial deformation under weight of the food.

18. The food holder of claim 1, wherein the restraint member is self-adjusting to accommodate hands of different sizes.

19. The food holder of claim 18, wherein the restraint member includes an expandable portion.

20. The food holder of claim 19, wherein the expandable portion includes an accordian fold member.

21. The food holder of claim 1 packaged as a unit including packaged therein at least one dining accessory.

22. The food holder of claim 21 including packaged therein a liquid holding container.

23. A method of manufacturing the self-balancing food holder of claim 1, comprising the step of forming the platter with at least one restraint member extending therefrom.

24. A food holder produced by the method of claim 23.

25. The food holder of claim 24 configured to be stacked in releasable relationship with another similarly configured like food holder and subsequently reconfigurable so that the restraining portion is vertically spaced from the lower surface of the platter.

26. A stack of at least two food holders of claim 25.

27. A food holder onto which food can be served or from which food can be eaten, which is self-balancing while being carried by one hand of a user comprising:

a platter having an upper surface for receiving and supporting food, and a lower surface for engaging the hand of the user; and a restraint member connected to the platter at laterally spaced locations, the restraint member having a restraining portion capable of being vertically spaced from the lower surface of the platter to define a passage for receiving the user's hand in interposed relationship between the platter and the restraining portion such that the platter can be engaged securely by the hand of the user and restrained against sideways tipping or falling from the user's hand;

the platter and restraint member being integrally formed from an initially flat sheet, subsequently foldable and joinable at a seam.

28. The food holder of claim 27 wherein at least the upper surface of the platter comprises liquid impermeable material.

29. The food holder of claim 27 wherein the sheet is formed of a disposable material.

30. The food holder of claim 29 wherein the disposable material is paper.

31. The food holder of claim 29 wherein the disposable material is plastic.

32. The food holder of claim 27 wherein the initially flat sheet of the platter is deformed in three dimensions to enhance rigidity of the platter.

33. A food holder onto which food can be served or from which food can be eaten, which is self-balancing while being carried by one hand of a user comprising:

a platter having an upper surface for receiving and supporting food, and a lower surface for engaging the hand of the user; and a restraint member connected to the platter at laterally spaced locations, the restraint member having a restraining portion capable of being vertically spaced from the lower surface of the platter to define a passage for receiving the user's hand in interposed relationship between the platter and the restraining portion such that the platter can be engaged securely by the hand of the user and restrained against sideways tipping or falling from the user's hand;

the platter and restraint member being integrally formed from an initially flat sheet, subsequently foldable and joinable at a seam;

the restraint member including a pair of wings extending integrally from diametrically opposite sides of a perimetrical edge of the platter, the wings being joinable at the seam.

34. A method of assembling a self-balancing food holder onto which food can be served or from which food can be eaten while being carried by one hand of a user, comprising the steps of:

a) providing a food holder, comprising a platter having an upper surface for receiving and supporting food and a lower surface for engaging the hand of the user, and a restraint member having wings connected to the platter at laterally spaced locations and extending in substantially coplanar relationship therefrom;

b) folding the wings of the restraint member under the platter and connecting the wings together to form a restraining portion vertically spaced from the lower surface of the platter to define a passage for receiving the user's hand in interposed relationship between the platter and the restraining portion such that the platter can be carried or held securely by the hand of the user and restrained against tipping or falling from the user's hand.

* * * * *

UNITED STATES PATENT AND TRADEMARK OFFICE

CERTIFICATE OF CORRECTION

PATENT NO. : 6,439,388 B1
DATED : August 27, 2002
INVENTOR(S) : Louis L. Lerner

It is certified that error appears in the above-identified patent and that said Letters Patent is hereby corrected as shown below:

Title page,
Item [76], Inventor, change "The Lerner Group, P.O. Box 10601, Chicago, IL (US) 60610-0601" to -- 900 Lake Shore Drive, Chicago, IL (US) 60611 --.

Column 6,
Line 11, change "therefrom;" to -- therefrom. --.
Line 25, delete the period character "." after the numeral "239".

Signed and Sealed this

Twelfth Day of August, 2003

JAMES E. ROGAN
*Director of the United States Patent and Trademark Office*